US011456129B1

(12) United States Patent
Wu et al.

(10) Patent No.: US 11,456,129 B1
(45) Date of Patent: Sep. 27, 2022

(54) KEY STRUCTURE

(71) Applicant: Primax Electronics Ltd., Taipei (TW)

(72) Inventors: Ming-Han Wu, Taipei (TW); Yi-Wei Chen, Taipei (TW); Hsien-Tsan Chang, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/507,880

(22) Filed: Oct. 22, 2021

(30) Foreign Application Priority Data

Mar. 12, 2021 (TW) ..... 110108970

(51) Int. Cl.
*H01H 13/7065* (2006.01)
*H01H 13/04* (2006.01)
*H01H 13/704* (2006.01)
*H01H 13/14* (2006.01)

(52) U.S. Cl.
CPC ..... *H01H 13/7065* (2013.01); *H01H 13/04* (2013.01); *H01H 13/14* (2013.01); *H01H 13/704* (2013.01)

(58) Field of Classification Search
CPC ..... H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20
See application file for complete search history.

(56) References Cited

U.S. PATENT DOCUMENTS

| | | | | |
|---|---|---|---|---|
| 10,289,210 | B1 * | 5/2019 | Wang | G06F 3/0445 |
| 10,353,485 | B1 * | 7/2019 | Zhang | G06F 3/0213 |
| 10,642,388 | B2 * | 5/2020 | Ma | G06F 1/1643 |
| 2016/0168779 | A1 * | 6/2016 | Russell-Clarke | H01H 11/00 8/102 |

* cited by examiner

*Primary Examiner* — Ahmed M Saeed
(74) *Attorney, Agent, or Firm* — Kirton McConkie; Evan R. Witt

(57) ABSTRACT

A key structure includes a protective cover and a keycap. The keycap includes flow-guiding bevel surface. When the protective cover and the keycap are adhered on each other through a glue material, an excess portion of the glue material is retained on the flow-guiding bevel surface. Consequently, the excess portion of the glue material will not spread to other regions.

8 Claims, 3 Drawing Sheets

KEY STRUCTURE

FIELD OF THE INVENTION

The present invention relates to a key structure, and more particularly to a key structure of a computer keyboard.

BACKGROUND OF THE INVENTION

Generally, a keyboard of a computer usually comprises plural keys. For preventing dust or liquid from entering the seams between keys or flowing into the underlying spaces, the keyboard is usually additionally equipped with a layer of soft and elastic protective cover. The protective cover is located over the keycaps of the keys to cover the keycaps in order to block dust or other foreign matters. Moreover, due to the elasticity and the flexibility of the protective cover, the user can smoothly press down the keycaps to trigger key signals. Moreover, for positioning the protective cover on the keycaps, it is necessary to attach a portion of the protective cover on the top surfaces of the keycaps. For example, a glue material is firstly coated on the region between the protective cover and the keycap, and then the protective cover is fixed on the keycap through the glue material. In other words, the region of the protective cover that is coated with glue material is positioned on the key, and the region of the protective cover that is not coated with the glue material can be elastically stretched at will. Consequently, when the keycap is pressed down, the region of the protective cover that is not coated with the glue material will not hinder the upward/downward movement of the keycap.

However, during the process of coating the glue material, some drawbacks occur. For example, regardless of whether the glue material is coated through a machine or through a manual spraying procedure, the glue material is usually unable to be coated evenly. Consequently, the excess portion of the glue material may overflow through the gap between the protective cover and the keycap. The overflowed portion of the glue material may flow to other regions on the surface of the keycap. In other words, some positions that are not required to be coated with the glue material are contaminated by the glue material. If the region of the protective cover that is designed to be elastically stretched is contaminated by the glue material and adhesively fixed on the keycap, the upward/downward movement of the keycap is pulled and hindered by the protective cover.

SUMMARY OF THE INVENTION

For solving the drawbacks of the conventional technologies, the present invention provides a key structure. A keycap of the key structure includes a flow-guiding bevel surface. When a glue material overflows through a gap between a protective cover and the keycap, the excess portion of the glue material can be retained on the flow-guiding bevel surface of the keycap, and the flow-guiding bevel surface can prevent the glue material from spreading to other regions of the keycap. Since the elastically-stretchable region of the protective cover is not contaminated by the glue material, the tactile feel and the operation of the key structure are not adversely affected.

In accordance with an aspect of the present invention, a key structure is provided. The key structure includes a base plate, an elastic element, a supporting element, a keycap and a protective cover. The elastic element is installed on the base plate. The supporting element is installed on the base plate and arranged around the elastic element. The keycap is located over the supporting element and connected with the supporting element. As the supporting element is moved, the keycap is correspondingly moved toward or away from the base plate. The keycap comprises a top surface and a flow-guiding bevel surface. The protective cover is located over the keycap to cover the top surface of the keycap. A glue material is applied to a region between the protective cover and the top surface of the keycap, so that the protective cover and the top surface of the keycap are adhered on each other through the glue material. When a portion of the glue material overflows from the top surface of the keycap, the overflowed portion of the glue material is retained on the flow-guiding bevel surface.

In an embodiment, the flow-guiding bevel surface is located at an edge of the keycap and arranged around the top surface of the keycap.

In an embodiment, an included angle between the flow-guiding bevel surface and the top surface of the keycap is larger than 180 degrees.

In an embodiment, the keycap further includes an outer wall, and the flow-guiding bevel surface is arranged between the outer wall and the top surface of the keycap.

In an embodiment, when the glue material overflows from the top surface of the keycap and the overflowed portion of the glue material is retained on the flow-guiding bevel surface, the outer wall of the keycap is not contaminated by the overflowed portion of the glue material.

In an embodiment, the protective cover includes a contact surface and a stretchable part. The stretchable part is located at an edge of the contact surface. The contact surface is adhered on the top surface of the keycap.

In an embodiment, the contact surface of the protective cover is aligned with the top surface and the flow-guiding bevel surface of the keycap, and only the contact surface is contaminated by the glue material.

In an embodiment, the stretchable part of the protective cover is not contacted with the top surface and the flow-guiding bevel surface of the keycap.

From the above descriptions, the keycap of the key structure is specially designed. The excess portion of the glue material can be retained on the flow-guiding bevel surface of the keycap, and the flow-guiding bevel surface can prevent the glue material from spreading to other regions. Since the protective cover is properly attached on the keycap, the possibility of resulting in the damage of the key structure is minimized and the tactile feel of pressing down the key structure is not adversely affected.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments and accompanying drawings.

Figure 1:
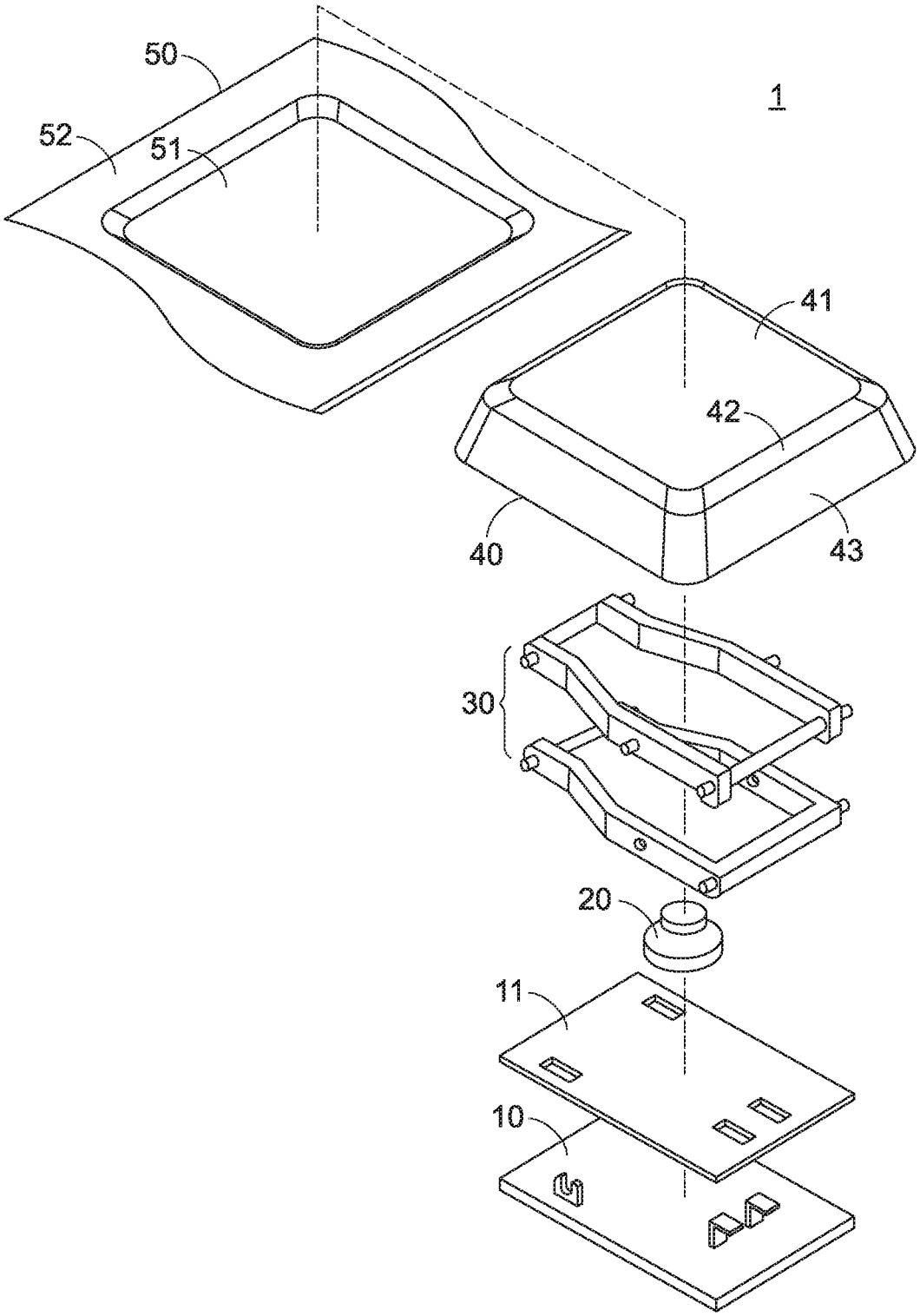
FIG. 1 is a schematic exploded view illustrating a key structure according to an embodiment of the present invention.

FIG. 1 is a schematic exploded view illustrating a key structure according to an embodiment of the present invention. As shown in FIG. 1, the key structure 1 comprises a base plate 10, a switch circuit layer 11, an elastic element 20, a supporting element 30, a keycap 40 and a protective cover 50.

The switch circuit layer 11 is installed on the base plate 10. The switch circuit layer 11 can generate a key signal. The elastic element 20 is installed on the base plate 10 and located over the switch circuit layer 11. The switch circuit layer 11 can be triggered by the elastic element 20. The supporting element 30 is installed on the base plate 10 and arranged around the elastic element 20. The keycap 40 is located over the supporting element 30 and connected with the supporting element 30. As the supporting element 30 is moved, the keycap 40 is moved with the supporting element 30 and moved toward or away from the base plate 10. When the keycap 40 is pressed down, the keycap 10 is moved downwardly toward the base plate 10 to push the elastic element 20. Consequently, a triggering part of the elastic element 20 is contacted with the switch circuit layer 11, and the switch circuit layer 11 is triggered to generate the key signal. The protective cover 50 is located over the keycap 40 to cover the keycap 40. The protective cover 50 is configured to prevent dust, moisture or any other foreign matter to enter the underlying region of the keycap 40. The protective cover 50 and the keycap 40 are adhered on each other through a glue material 60. Consequently, the protective cover 50 is positioned on the keycap 40. In accordance with a feature of the present invention, the structure of the keycap 40 is specially designed to confine the overflow range of the glue material 60 and prevent the glue material 60 from contaminating other components.

The structures of the keycap 40 and the protective cover 50 will be described as follows. The keycap 40 comprises a top surface 41, a flow-guiding bevel surface 42 and an outer wall 43. The top surface 41 is located at an upper portion of the keycap 40. The outer wall 43 is the outer periphery wall of the keycap 40. The flow-guiding bevel surface 42 is located at an edge of the upper portion of the keycap 40 and arranged around the top surface 41. Moreover, the flow-guiding bevel surface 42 is arranged between the top surface 41 and the outer wall 43. The protective cover 50 comprises a contact surface 51 and a stretchable part 52. The stretchable part 52 is located at an edge of the contact surface 51. Moreover, the contact surface 51 is adhered on the top surface 41 of the keycap 40.

Figure 2:
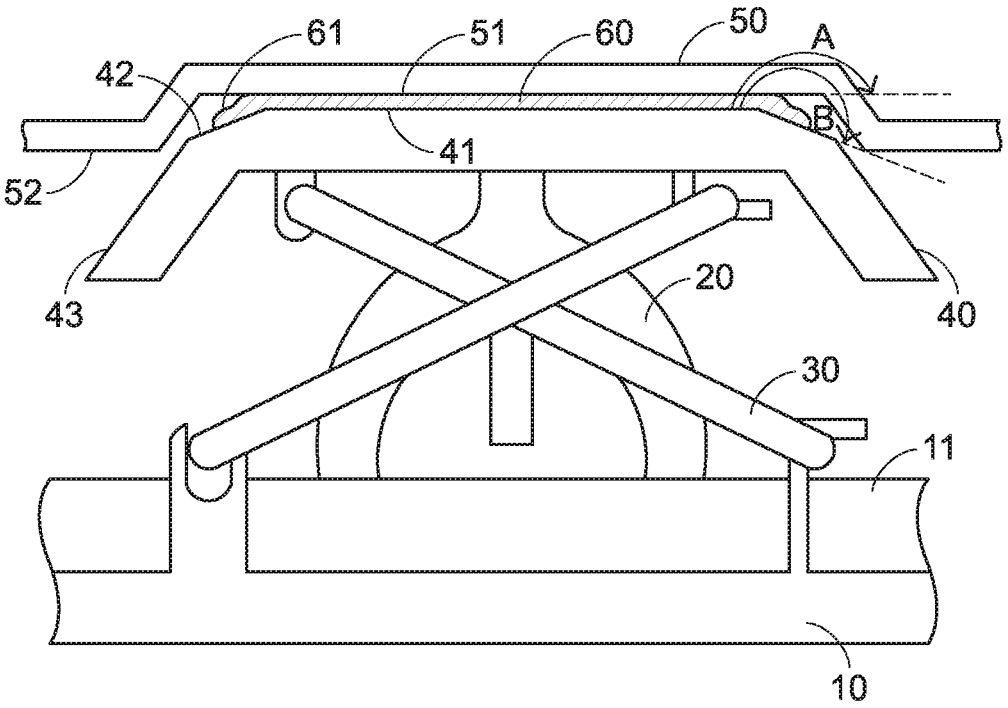
FIG. 2 is a schematic side view illustrating the key structure according to the embodiment of the present invention.

FIG. 2 is a schematic side view illustrating the key structure according to the embodiment of the present invention. The protective cover 50 is located over the keycap 40 to cover the keycap 40. In addition, the contact surface 51 of the protective cover 50 is aligned with the top surface 41 of the keycap 40. The glue material 60 is applied to the region between the contact surface 51 of the protective cover 50 and the top surface 41 of the keycap 40. Consequently, the protective cover 50 and the top surface 41 of the keycap 40 are adhered on each other through the glue material 60.

In case that the amount of the glue material 60 between the contact surface 51 of the protective cover 50 and the top surface 41 of the keycap 40 is more than the acceptable amount, the excess portion of the glue material 60 overflows through the gap between the contact surface 51 and the top surface 41. The overflowed portion 61 of the glue material 60 flows to the flow-guiding bevel surface 42 along the top surface 41. In other words, the flow-guiding bevel surface 42 provides a buffering slant plane for retaining the overflowed portion 61 of the glue material 60 and preventing the overflowed portion 61 of the glue material 60 from continuously spreading. Consequently, the outer wall 43 of the keycap 40 will not be contaminated by the overflowed portion 61 of the glue material 60. In other words, the purpose of avoiding the contamination and the spread of the glue material 60 will be achieved.

In an embodiment, the included angle B between the flow-guiding bevel surface 42 and the top surface 41 of the keycap 40 is larger than 180 degrees, preferably in the range between 183 and 195 degrees. Since the glue material 60 has the viscous retardation property and becomes stiffness after drying, the overflowed portion 61 of the glue material 60 gradually retards and flows slowly on the flow-guiding bevel surface 42. Then, the overflowed portion 61 of the glue material 60 is solidified and retained on the flow-guiding bevel surface 42.

Figure 3:
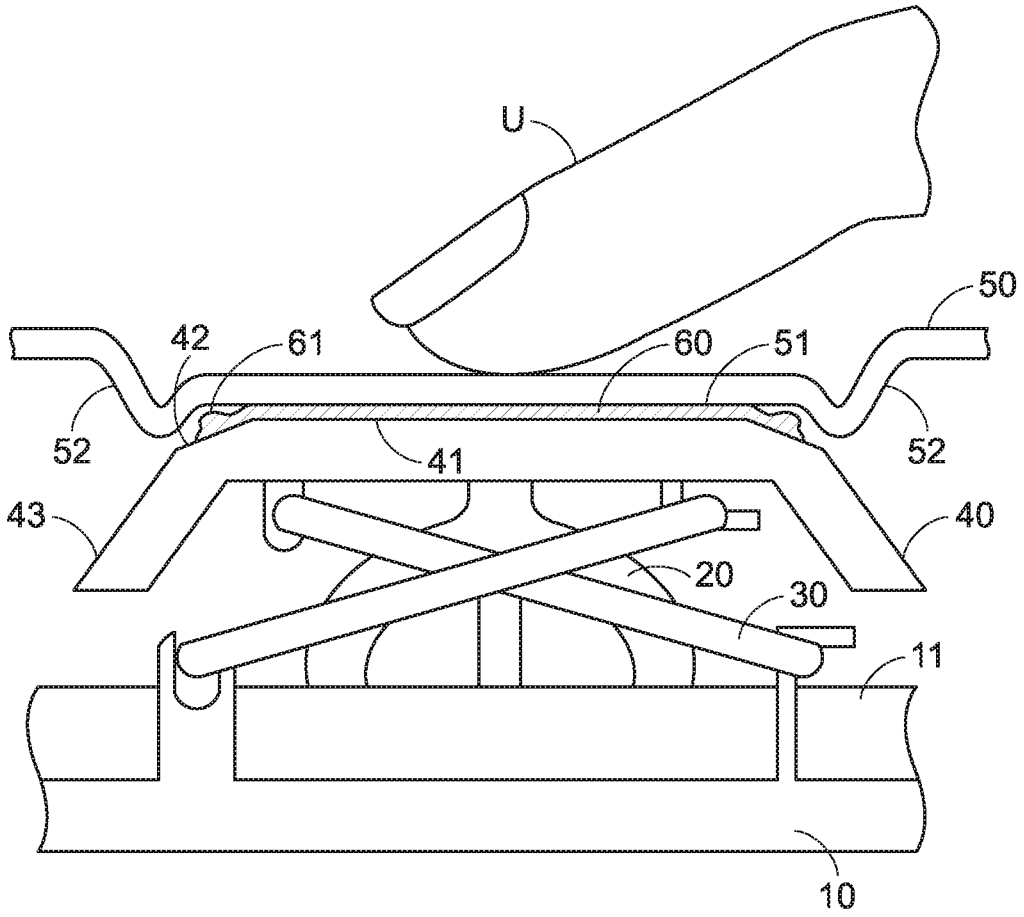
FIG. 3 is a schematic side view illustrating the key structure in a depressed state.

The usage condition of the key structure 1 will be described as follows. FIG. 3 is a schematic side view illustrating the key structure in a depressed state. The area of the contact surface 51 of the protective cover 50 is larger than the area of the top surface 41 of the keycap 40. The range of the contact surface 51 of the protective cover 50 covers the top surface 41 and the flow-guiding bevel surface 42 of the keycap 40. Consequently, only the contact surface 51 of the protective cover 50 can be contaminated by the glue material 60. Since the stretchable part 52 of the protective cover 50 is not contacted with the top surface 41 and the flow-guiding bevel surface 42 of the keycap 40, the stretchable part 52 of the protective cover 50 will not be contaminated by the glue material 60.

When the protective cover 50 and the keycap 40 are pressed down by a user's finger U, the keycap 40 is moved downwardly toward the base plate 10. As the keycap 40 is moved downwardly, the top surface 41 of the keycap 41 and the contact surface 51 of the protective cover 50 are collaboratively moved toward the base plate 51. Since the stretchable part 52 of the protective cover 50 is not contaminated by the glue material 60, the stretchable part 52 of the protective cover 50 can be elastically stretched. Since the stretchable part 52 can be elastically curved and extended, the keycap 40 can be stably descended to the base plate 10 while triggering the switch circuit layer 11.

In an embodiment, the protective cover 50 is a layer of soft and elastic rubber sheet with good stretching elasticity. The flow-guiding bevel surface 42 of the keycap 40 is formed on the periphery of the top surface 41 of the keycap 40 by a cutting process or an integral formation process.

From the above descriptions, the keycap of the key structure is specially designed. The excess portion of the glue material can be retained on the flow-guiding bevel surface of the keycap, and the flow-guiding bevel surface can prevent the glue material from spreading to other regions. Consequently, other regions or components will not be contaminated by the glue material, and the key structure can be smoothly pressed down while maintaining the satisfied appearance.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a base plate;

an elastic element installed on the base plate;

a supporting element installed on the base plate and arranged around the elastic element;

a keycap located over the supporting element and connected with the supporting element, wherein as the supporting element is moved, the keycap is correspondingly moved toward or away from the base plate, wherein the keycap comprises a top surface and a flow-guiding bevel surface; and a protective cover located over the keycap to cover the top surface of the keycap, wherein a glue material is applied to a region between the protective cover and the top surface of the keycap, so that the protective cover and the top surface of the keycap are adhered on each other through the glue material, wherein when a portion of the glue material overflows from the top surface of the keycap, the overflowed portion of the glue material is retained on the flow-guiding bevel surface.

2. The key structure according to claim 1, wherein the flow-guiding bevel surface is located at an edge of the keycap and arranged around the top surface of the keycap.

3. The key structure according to claim 1, wherein an included angle between the flow-guiding bevel surface and the top surface of the keycap is larger than 180 degrees.

4. The key structure according to claim 1, wherein the keycap further comprises an outer wall, and the flow-guiding bevel surface is arranged between the outer wall and the top surface of the keycap.

5. The key structure according to claim 4, wherein when the glue material overflows from the top surface of the keycap and the overflowed portion of the glue material is retained on the flow-guiding bevel surface, the outer wall of the keycap is not contaminated by the overflowed portion of the glue material.

6. The key structure according to claim 1, wherein the protective cover comprises a contact surface and a stretchable part, wherein the stretchable part is located at an edge of the contact surface, and the contact surface is adhered on the top surface of the keycap.

7. The key structure according to claim 6, wherein the contact surface of the protective cover is aligned with the top surface and the flow-guiding bevel surface of the keycap, and only the contact surface is contaminated by the glue material.

8. The key structure according to claim 6, wherein the stretchable part of the protective cover is not contacted with the top surface and the flow-guiding bevel surface of the keycap.

* * * * *